US009542867B2

(12) United States Patent
Hochfelsen

(10) Patent No.: US 9,542,867 B2
(45) Date of Patent: Jan. 10, 2017

(54) VEHICLE PARKING SPACE SIGN SYSTEM

(71) Applicant: Jerrold J. Hochfelsen, Plantation, FL (US)

(72) Inventor: Jerrold J. Hochfelsen, Plantation, FL (US)

( * ) Notice: Subject to any disclaimer, the term of this patent is extended or adjusted under 35 U.S.C. 154(b) by 0 days.

(21) Appl. No.: 14/296,966

(22) Filed: Jun. 5, 2014

(65) Prior Publication Data

US 2015/0101222 A1 Apr. 16, 2015

Related U.S. Application Data

(60) Provisional application No. 61/889,070, filed on Oct. 10, 2013.

(51) Int. Cl.

| | |
|---|---|
| ***G09F 13/00*** | (2006.01) |
| ***G09F 7/00*** | (2006.01) |
| ***G09F 7/18*** | (2006.01) |
| ***G09F 13/20*** | (2006.01) |
| ***G09F 19/22*** | (2006.01) |
| *G09F 13/18* | (2006.01) |
| *G09F 13/04* | (2006.01) |

(52) U.S. Cl.

CPC ..... *G09F 7/002* (2013.01); *G09F 7/18* (2013.01); *G09F 13/20* (2013.01); *G09F 19/228* (2013.01); *G09F 13/04* (2013.01); *G09F 2007/1843* (2013.01); *G09F 2007/1856* (2013.01); *G09F 2007/1878* (2013.01); *G09F 2013/1881* (2013.01)

(58) Field of Classification Search

CPC ..... G09F 19/22; G09F 7/08; G09F 7/02; G09F 7/10; G09F 7/16; G09F 3/20; G09F 3/18; G09F 1/12; G09F 1/10; G09F 23/00; G09F 3/204; G09F 3/201; E01F 9/0536; E01F 9/065; A44C 15/004

See application file for complete search history.

(56) References Cited

U.S. PATENT DOCUMENTS

| | | | | |
|---|---|---|---|---|
| 3,977,112 | A * | 8/1976 | Breer, II | 40/760 |
| 5,933,994 | A * | 8/1999 | Misaresh | 40/649 |
| 6,886,282 | B2 * | 5/2005 | Sumner et al. | 40/593 |
| 7,216,447 | B2 * | 5/2007 | Bateman | 40/618 |
| 7,351,003 | B1 * | 4/2008 | Fenimore et al. | 404/7 |

* cited by examiner

*Primary Examiner* — Cassandra Davis

(74) *Attorney, Agent, or Firm* — David P. Lhota, Esq.; Lhota & Associates, P.A.

(57) ABSTRACT

A parking space sign system that is mountable to existing parking bumpers or includes a flexible support structure for placement in parking spaces with parking bumpers, a frame mount having at least one transparent frame sleeve formed by sleeve flanges, at least one panel with indicia on its face and at least one mounting aperture for mounting the frame to a parking bumper with hardware or slotted end caps instead of mounting apertures in the frame mount for sealing the ends of the frame mount and securing it to a parking bumper.

12 Claims, 6 Drawing Sheets

VEHICLE PARKING SPACE SIGN SYSTEM

CROSS REFERENCE TO RELATED APPLICATIONS

This application claims the benefit of provisional patent application Ser. No. 61/889,070 filed Oct. 10, 2013.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

This invention relates generally to a parking space sign system and more particularly, to a parking space sleeve system that mounts to existing parking lot bumpers and displays interchangeable and, or illuminable advertising or sign panels.

2. Description of the Background Art

Parking spot bumpers are well known and common place in almost every parking lot. Conventional parking spaces bumpers are approximately four (4) feet long, eight (8) inches wide and five (5) inches high and made from concrete. Oftentimes office buildings have designated parking spaces noted by painted indicia of the owner's parking spot on the outside of the parking bumper or a company name. However, these painted signs are permanent or require frequent upkeep or touch-ups. Advertising signs and covers are also known that are affixed to the exterior of the parking bumper. These signs are exposed to inclement weather, bird droppings, hot automobile liquid droppings and other elements that damage and erode the signs in a short time. They are also easily stolen or vandalized. In addition, known parking bumper covers are typically not illuminable and those that do illuminate comprise inefficient energy circuitry. Lastly, existing parking bumper covers are adapted for only one type of parking bumper. If there existed a parking lot bumper advertising system that accommodated interchangeable and theft protected advertising panels that could also illuminate at night with energy efficient technology and that adapted to parking lot bumpers of varying shapes and sizes it would address these shortcomings and be well received. However, there are no known parking lot bumper advertising systems that adequately or effectively address these needs.

Parking spaces also exist that do not have parking bumpers, yet it would still be desirable and advantageous to be able to place signs or advertisements in these spots as well. Attempts to provide signs in parking areas vary in design. For instance, there exists ground-mounted devices that do not have interchangeable signs and are rigid such that they could cause damage to a vehicle if hit or run over. There is also a promotion distribution system known that distributes promotions based on where a user has parked which allows merchants to target promotions remotely to where someone parks. Advertising devices and systems consisting of signs adhered to the road, parking space or on a wall are known. Known devices such as these are too complicated, susceptible to damage due to inclement weather, vehicle drips and animal droppings or not easily interchangeable.

Accordingly, existing devices and systems for advertising or placing signs in parking spaces do not adequately address or resolve the issues in the background art. Therefore, there exists a need for a parking bumper advertising system that resolves these issues. It is, therefore, to the effective resolution of the aforementioned problems and shortcomings of the prior art that the present invention is directed. The instant invention addresses this unfulfilled need in the prior art by providing an advertising system for parking spaces as contemplated by the instant invention disclosed herein. The instant invention is not limited to parking lot bumpers and may be used with any underlying structure.

BRIEF SUMMARY OF THE INVENTION

In light of the foregoing, it is an object of the present invention to provide a parking space sign system.

It is also an object of the instant invention to provide a parking space advertising system.

It is another object of the instant invention to provide a parking space sign system that is mountable to a parking bumper.

It is an additional object of the instant invention to provide a parking space sign system having interchangeable sign panels that are convenient to install and replace.

It is a further object of the instant invention to provide a parking space sign system having removable end caps.

It is yet another object of the instant invention to provide a parking space sign system that illuminates at night.

It is yet a further object of the instant invention to provide a parking space sign system that is cost effective for mass production.

In light of these and other objects, the instant invention comprises a parking space sign system that is mountable to existing parking bumpers or includes a flexible support structure for placement in parking spaces with parking bumpers. The parking space sign system generally comprises a frame mount having at least one transparent frame sleeve, sleeve flanges defining a panel receiving and securing passage, at least one panel with indicia on its face, and at least one mounting aperture proximal each for mounting the frame to a parking bumper with hardware. The parking space sign system may include slotted end caps instead of mounting apertures in the frame mount for sealing the ends of the frame mount and securing it to a parking bumper. In the preferred embodiment, the parking space sign system comprises a top sleeve defined by flanges, front sleeve defined by flanges, mounting apertures in the sleeves or slotted end caps for mounting the system to a parking bumper and a plurality of interchangeable sign panels.

In accordance with these and other objects, which will become apparent hereinafter, the instant invention will now be described with particular reference to the accompanying drawings.

DETAILED DESCRIPTION OF THE INVENTION

With reference to the drawings, FIGS. 1 to 16 depict the preferred and alternative embodiments of the instant invention which is generally referenced as a vehicle parking bumper advertising system, parking bumper advertising system and, or by numeric character 10 or 100. The instant invention 10 comprises an advertising parking bumper advertising system that mounts over and secured to a conventional parking lot bumper to display advertising. The parking bumper advertising system 10 displays the advertisement from within its structure so as to protect the advertisement from inclement weather, bird droppings, hot automobile liquid drippings and other elements that would damage and erode the signage. By displaying the advertisement from within the parking bumper advertising system 10 also helps to prevent or minimize theft. The instant invention 10 is also designed to accommodate interchangeable advertising signage or personal parking space signage. The parking bumper advertising system 10 can also display advertisements on the front, top and back surfaces of the parking bumper. In alternative embodiments, the parking bumper advertising system 10 is adaptable to different types of parking bumpers.

Figure 1:
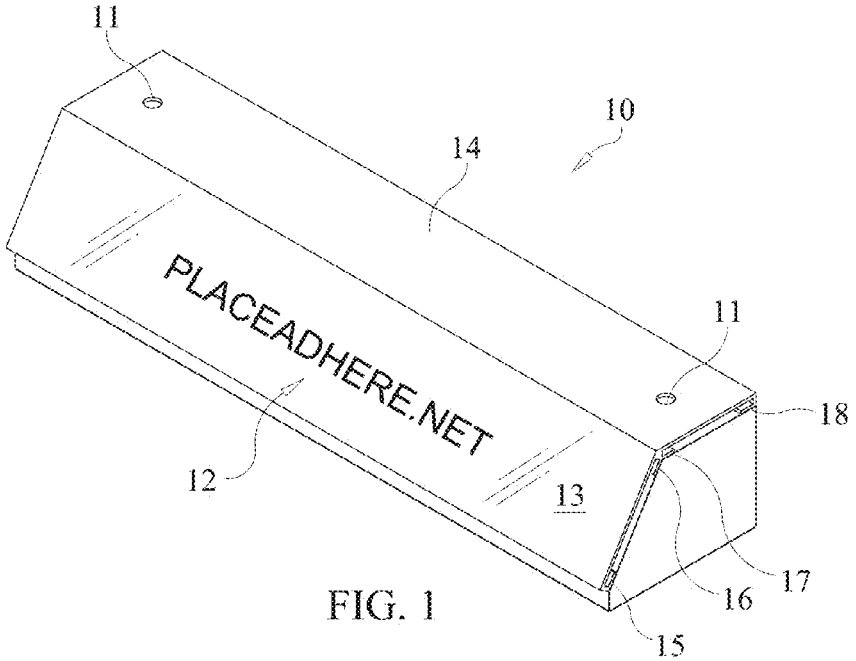
FIG. 1 is a perspective view of the parking space advertising system mounted to a parking bumper in accordance with the instant invention.
Figure 2:
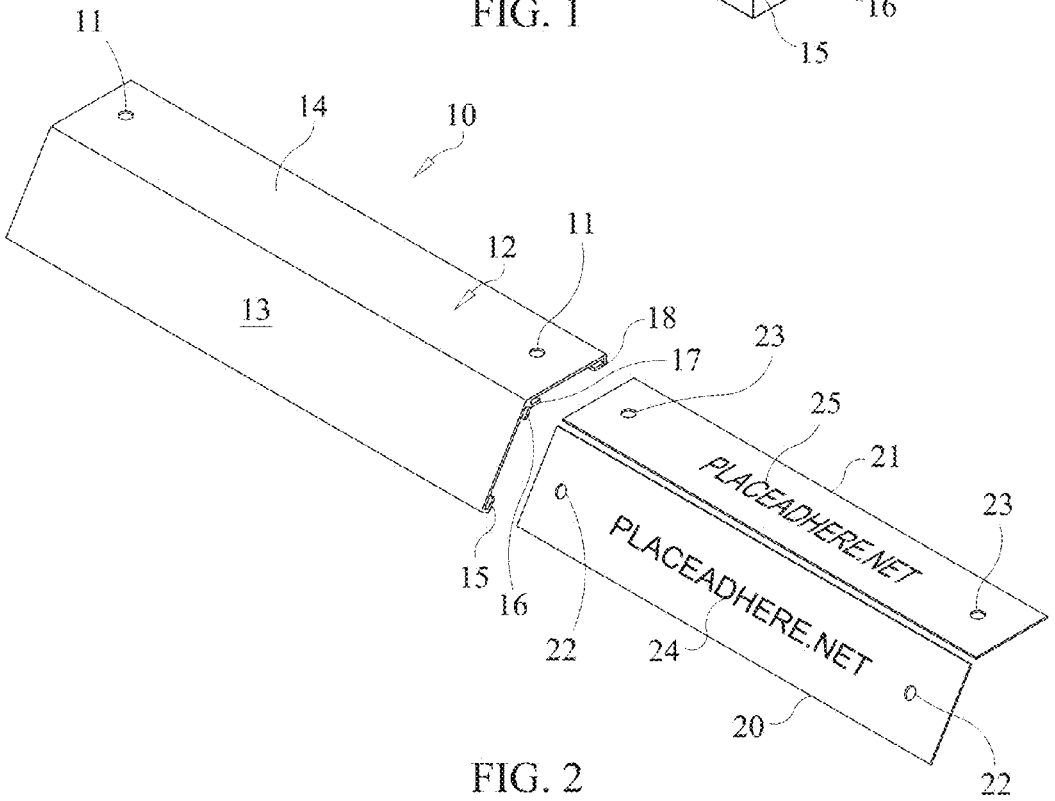
FIG. 2 is a perspective view of the parking space advertising system showing a two channel system with the advertising panels exploded from the frame mount in accordance with the instant invention.
Figure 3:
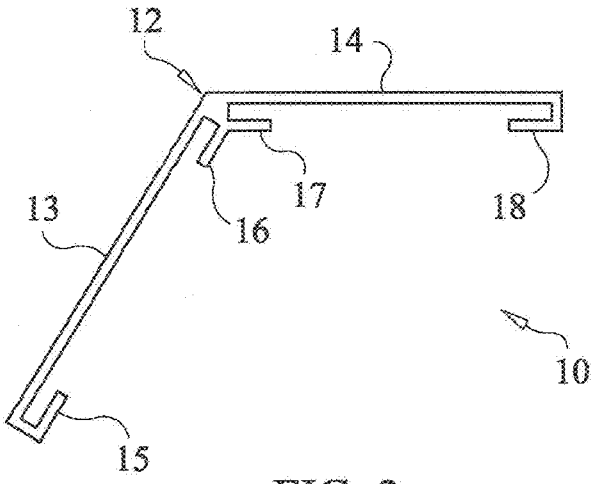
FIG. 3 is a side elevational view of the parking space advertising system showing a two channel system in accordance with the instant invention.

With reference to FIGS. 1-3, in the preferred embodiment of the instant invention the vehicle parking bumper advertising system 10 comprises a frame mount 12, a frame mount front panel 13, a frame mount top panel 14, at least one mounting aperture 11 in the top panel 14, an interchangeable front advertising panel 20, an interchangeable top advertising panel 21, front panel sleeve flanges 15 and 16, and top panel sleeve flanges 17 and 18. The parking bumper advertising system 10 may also comprise fasteners for attaching the frame mount 12 to a parking bumper. The preferred fastener's for concrete parking bumpers are screws adapted for concrete such as those sold under the trademark Tapcon®. The frame mount 12 is manufactured from a durable transparent material that holds at least one advertising panel 20 or 21 along its interior or rear surface to display the advertisement or name through the transparent frame mount 12 while protecting it from ambient elements. The unique shape of the frame mount 12 allows for convenient insertion and changing of advertisement panels 20 or 21. The frame mount 12 is preferably made through an extrusion process and comprises a plastic or plastic-like material that is heat resistant to the hottest ambient temperatures such that it does not melt or warp and moisture resistant. The instant invention 10 also comprises an illumination source for illuminating the advertising panels 20 or 21 at night or in dim light such that the advertisement, name or message on the panel 20 or 21 glows.

Still referring to FIGS. 1-3, the front panel sleeve flanges comprise a lower or bottom front panel flange 15 that bends inward and upward from the rear or inside surface of the front panel 13 and an upper or top front panel flange 16 bends inward and downward from the rear or inside surface of the front panel 13. The front panel flanges 15 and 16 may have a lower wall 15*a* and upper wall 16*a*, respectively, and define an interior front advertising panel channel along the rear surface of the front panel 13 for slidably supporting a front advertising panel 20. As shown FIGS. 1-3, the top panel sleeve flanges comprise a forward top panel flange 17 that bends inward and backward from the rear or inside surface of the top panel 14 and a rear top panel flange 18 that bends inward and forward from the rear or inside surface of the top panel 14. The top panel flanges 17 and 18 define an interior top advertising panel channel along the rear surface of the top panel 14 for slidably supporting a top advertising panel 21.

Figure 4:
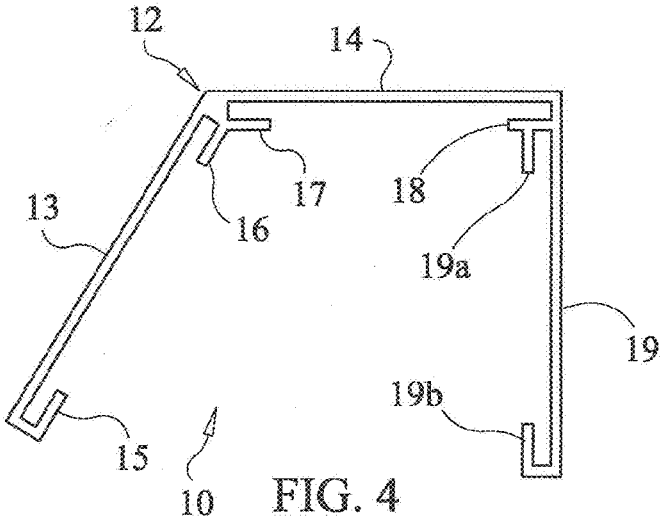
FIG. 4 is a side elevational view of the parking space advertising system showing a three channel system in accordance with the instant invention.

With reference to FIG. 4, the frame mount 12 may comprise a front panel 13, top panel 14 and rear panel 19. As disclosed with reference to FIGS. 1-3, the front panel 13 comprises a bottom front panel flange 15 and top front panel 16 and the top panel 14 comprises a forward top panel flange 17 and rear top panel flange 18. The rear panel 19 comprises rear panel sleeve flanges which include a top rear panel flange 19*a* that bends inward and downward from the rear or inside surface of the rear panel 19 and a bottom rear panel flange 19*b* that bends inward and upward from the rear or inside surface of the rear panel 19, as shown in FIG. 4. The rear panel flanges 19*a* and 19*b* define an interior rear advertising panel channel along the rear surface of the rear panel 19 for slidably supporting an advertising panel 20. The rear panel 19 is also transparent for displaying advertisements or a name from the rear side of a parking lot bumper.

Figure 5:
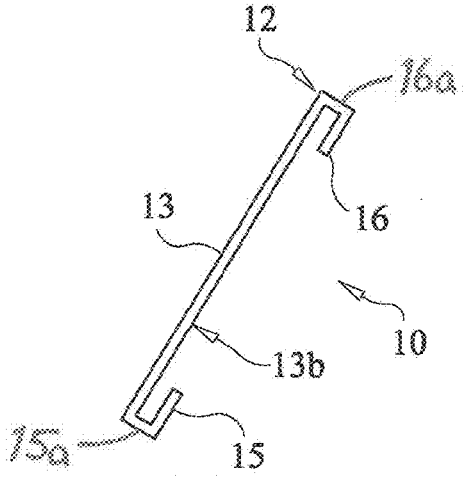
FIG. 5 is a side elevational view of the parking space advertising system showing a single channel system in accordance with the instant invention.

With reference to FIG. 5, the frame mount 12 may comprise only a front panel 13, with a rear face 13*b* and panel flanges 15 and 16 that create channels for slidably receiving display media panels and securing same with a friction fit. The single panel design of the frame mount 12 allows attaching the vehicle parking bumper advertising system 10 to any surface defining or marking a parking space.

Figure 6:
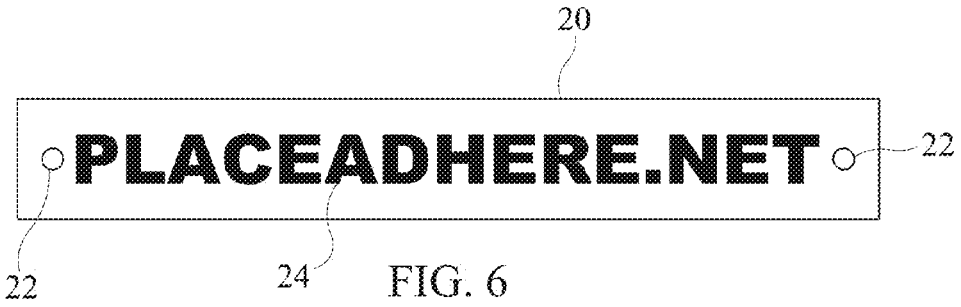
FIG. 6 is an elevational view of an advertising panel of the parking space advertising system in accordance with the instant invention.
Figure 7:
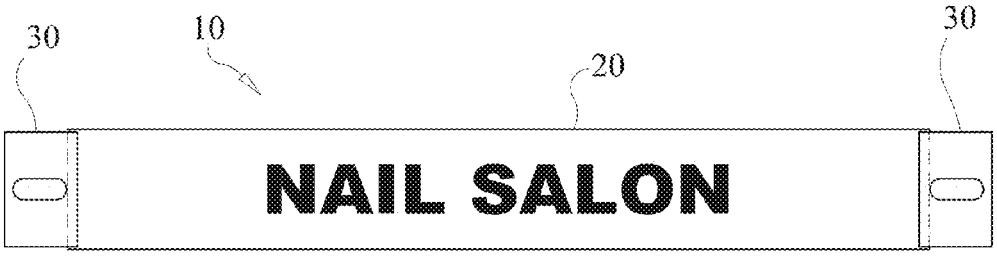
FIG. 7 is an elevational view of an advertising panel with end cap inserts used in the parking space advertising system in accordance with the instant invention.
Figure 8:
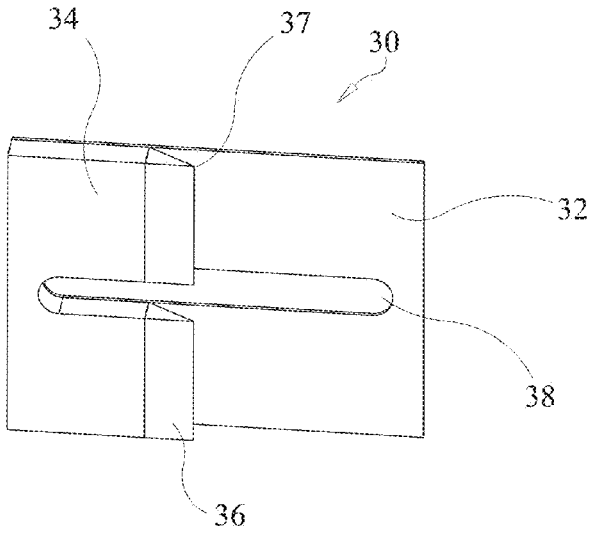
FIG. 8 is a perspective view of the end cap insert used in the parking space advertising system in accordance with the instant invention.
Figure 9:
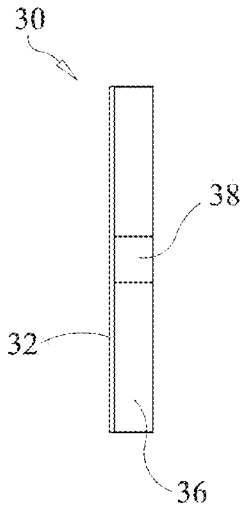
FIG. 9 is an end elevational view of the end cap inserts used in the parking space advertising system in accordance with the instant invention.

With reference to FIGS. 6-8, the advertising panels comprise a front or rear advertising panel 20 and, or top advertising panel 21 which comprise an elongated plastic or plastic-like substrate that is heat and moisture resistant. Different advertising panels 20 and 21 may be required to accommodate the size of the parking bumper's surfaces. The first advertising panel 20 comprises indicia 24 for displaying an advertisement, name or title and may include mounting apertures 22. The top advertising panel 21 comprises indicia 25 for displaying an advertisement, name or title and may include mounting apertures 23. Referring to FIG. 7, an advertising panel 20 or 21 may be secured in any frame mount 12 sleeve channel and to a parking bumper by an end cap 30. With reference to FIG. 8, the end cap 30 comprises a flat plate 32 with a flange 34 projecting upward from the plate 32 and a lip 36 formed at the interior end of the flange 34 for catching the side of the frame mount 12. A slot 38 extends across the plate 32 and into the flange 34 for receiving a fastener, such as a screw or bolt. The lip 36 defines a recessed groove 37 for receiving the edge of the frame mount 12, as shown in FIG. 7. An end cap 30 is inserted into each end of the frame mount 12 into the frame sleeve creating a friction fit that secures the sign panel 20 or 21 while sealing off the end of the frame mount sleeve from moisture. The frame mount 12 is attached to a parking bumper by passing a fastener through the slotted aperture 38 and fastening it to the parking bumper. For concrete parking bumpers or surfaces, the preferred fastener is one adapted for concrete such as those sold under the trademark Tapcon®.

Figure 10:
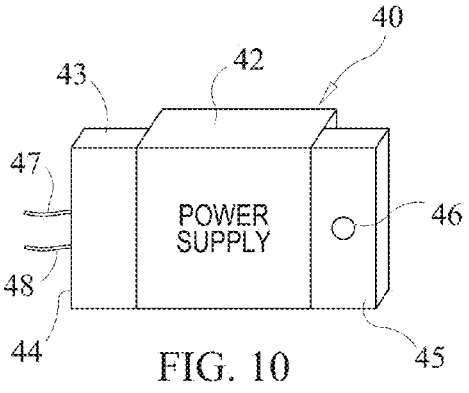
FIG. 10 is a perspective view of a power supply mount insert that may be used in the parking space advertising system in accordance with the instant invention.
Figure 11:
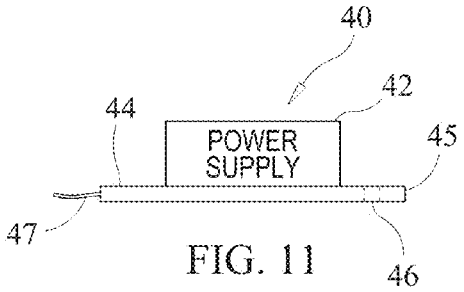
FIG. 11 is a plan view of the power supply mount insert used in the parking space advertising system in accordance with the instant invention.

With reference to FIGS. 10 and 11, the advertising panel 20 or 21 may be secured at one end by a power source module 40 that secures one end of the advertising panel 20 or 21 while electrically connecting to the panel 20 or 21 with electrical leads 47 and 48 that electrically connect the panel 20 or 21 to the power source 42. The power source 42 preferably comprises a solar battery 42 that is energized during the day by a solar panel 43. The electrical leads 47 and 48 extend from a first end 44 of the solar panel 43 to a light source 49. An aperture 46 is defined at an opposite end 45 of the solar panel 43 for securing the power source module 40 to a parking bumper, such as with a Tapcon®. The first end 44 physically secures the inside edge of an advertising panel 20 or 21.

As noted, the advertising panels 20 or 21 are designed to illuminate at night and comprise an illumination source. The illumination source may comprise the advertising panels 20, 21 and, or their indicia 24, 25 being made from a luminescence material that absorbs light energy during the day and glows at night.

Figure 12:
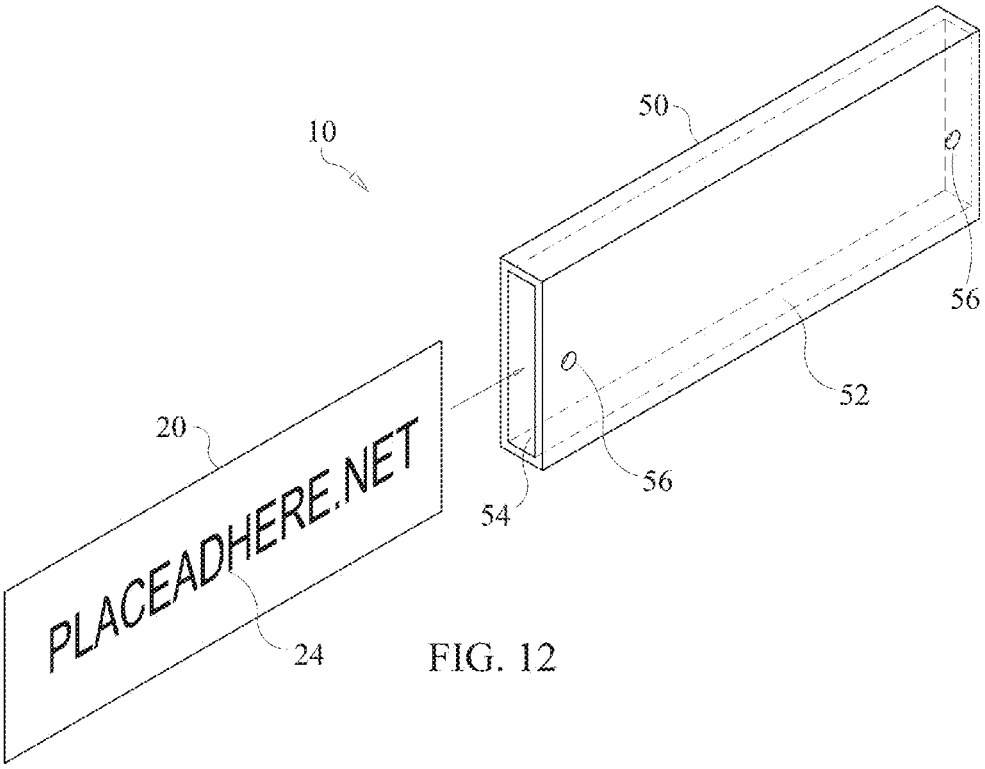
FIG. 12 is a perspective view of the parking space advertising system showing a fully enclosed frame mount with an advertising panel exploded from the enclosed frame mount in accordance with the instant invention.
Figure 13:
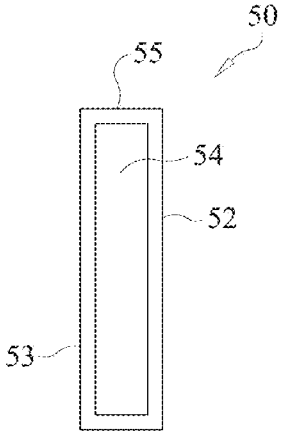
FIG. 13 is a side elevational view of the parking space advertising system showing a fully enclosed frame mount in accordance with the instant invention.
Figure 14:
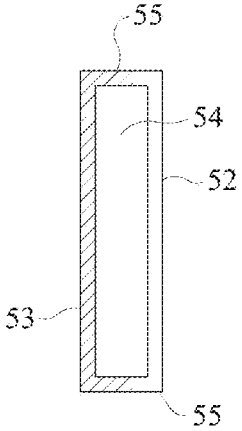
FIG. 14 is a side elevational view of the parking space advertising system showing a fully enclosed frame mount having a clear front surface and opaque rear surface in accordance with the instant invention.

With reference to FIGS. 12-14, the advertising parking bumper system 10 may comprise a fully enclosed frame mount 50. The enclosed frame mount 50 comprises a transparent front face 52, rear face 53 and a pair of side faces 55, and defines an enclosed channel 54 for slidably receiving an advertising panel 20 or 21 via a friction fit. The rear face 53 and side faces 55 may be opaque as shown in FIG. 14. The enclosed frame mount 50 may include mounting apertures 56, however in the preferred embodiment, apertures are locate on end caps that slide into the channel 54 and are retained in place via a friction fit. The opposite ends may be adapted for receiving a fastener, such as a Tapcon®, that screws into a parking bumper surface or other parking surface to secure the frame mount 50.

Figure 15:
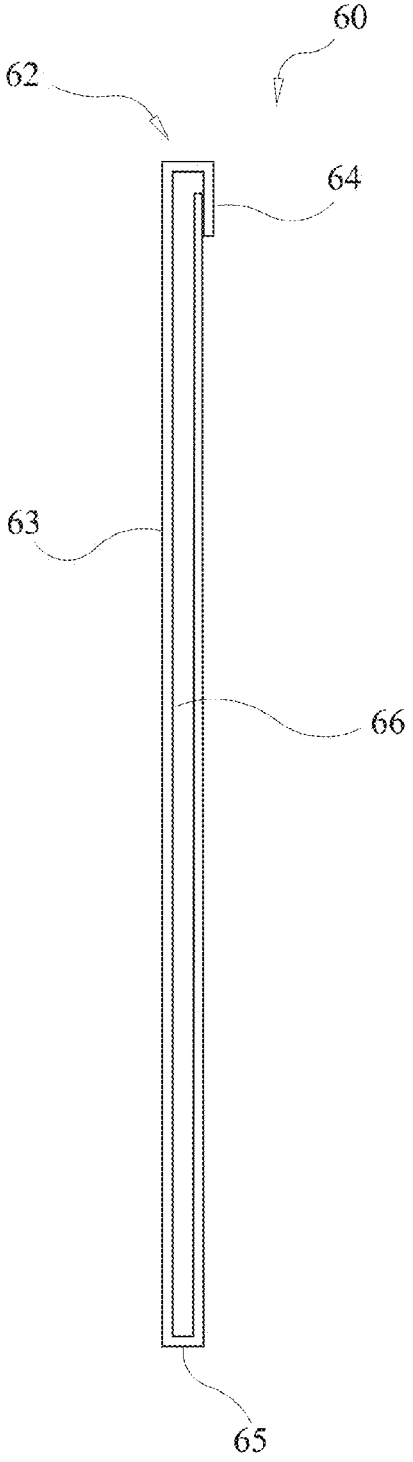
FIG. 15 is a front elevational view of an alternative embodiment of the parking space advertising system having a flexible and lockable panel shown in a closed position in accordance with the instant invention.
Figure 16:
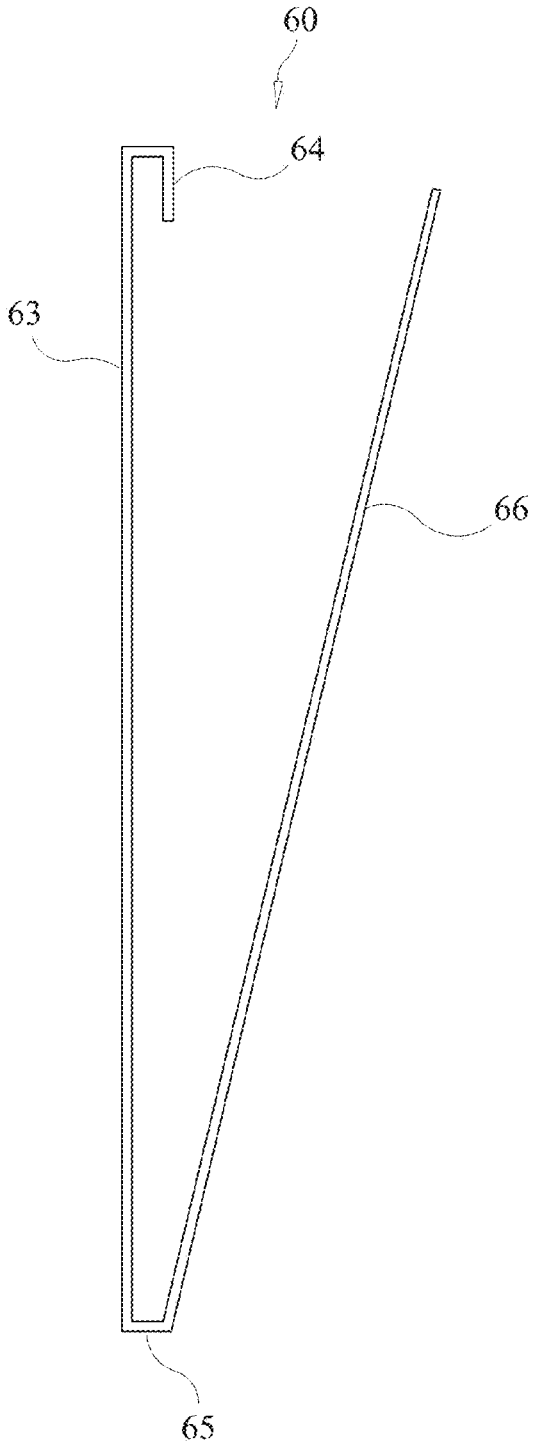
FIG. 16 is a front elevational view of the alternative embodiment of the parking space advertising system of FIG. 15 shown in an open position in accordance with the instant invention

With reference to FIGS. 15-16, in another alternative embodiment, the instant invention 10 comprises a frame mount 60 having a top end 62, a fixed front wall or surface 63, a flange 64 depending from the top end 62 and a flexible rear wall or surface 66 projecting from a lower end 65 of the frame mount 60. The rear wall 66 can be pulled back to open up the frame mount 60 for inserting a sign panel 20 or 21 into the sleeve defined by the frame mount 60. Once the panel 20 or 21 is in place, the rear wall 66 is pressed under the flange 64 and locked in place.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A vehicle parking space media display system for displaying interchangeable signs in a parking space, said media display system comprising:

a frame mount including:

a first wall having a front surface, a rear surface, an upper end and a lower end and a first side end and a second side end; an upper wall projecting from said upper end and a lower wall projecting from said lower end and opposing said upper wall;

an upper flange depending from said upper wall behind said rear surface and having a free elongated end;

a lower flange projecting from said lower wall toward said upper flange behind said rear surface and having a free elongated end;

an upper channel defined by said upper flange and said rear surface, and a lower channel defined said lower flange and said rear surface; and an unobstructed space defined between said free end of said upper flange and said free end of said lower flange;

a first end cap including a first flat surface having a first distal end that is slidably insertable in said upper channel and said lower channel at said first side end of said frame mount creating a friction fit and sealing access to said upper channel and said lower channel; and said first end cap having a first proximal end opposite said first distal end, said first end cap having an elongated aperture for use in securing said frame mount to a surface in said parking space and a first lip projecting from said first flat surface proximal said first proximal end for engaging said first side end of said frame mount, said first lip having a first angled wall projecting downward and inward toward said first flat surface so as to define a first groove for receiving said first side end of said frame mount; and a second end cap including a second flat surface having a second distal end that is slidably insertable in said upper channel and said lower channel at said second side end of said frame mount creating a friction fit and sealing access to said upper channel and said lower channel; and said second end cap having a second proximal end opposite said second distal end, said second end cap having an elongated aperture for use in securing said frame mount to a surface in said parking space and a second lip projecting from said second flat surface proximal said second proximal end for engaging said second side end of said frame mount, said second lip having a second angled wall projecting downward and inward toward said second flat surface so as to define a second groove for receiving said second side end of said frame mount.

2. A media display system as recited in claim 1, wherein said first wall is transparent.

3. A media display system as recited in claim 1, further comprising:

a second wall projecting outward from said upper end of said first wall and said upper wall, said second wall forming an angle with said first wall and having a top surface, a bottom surface, an inside wall projecting from said second wall and an outside wall projecting from said second wall and opposing said inside wall;

an inside flange projecting inward from said inside wall below said bottom surface; and an outside flange projecting inward from said outside wall toward said inside flange below said bottom surface; and a second channel defined by said inside flange, said outside flange and said bottom surface.

4. A media display system as recited in claim 3, further comprising:

a third wall depending downward from said outside wall of said second wall, said third wall having an inside surface, an outside surface, a top wall and a bottom wall;

a top inside flange projecting downward from said top wall along said inside surface; and a bottom inside flange projecting upward from said bottom wall toward said upper inside flange along said inside surface; and a third channel defined by said top inside flange, said bottom inside flange and said inside surface.

5. A media display system as recited in claim 4, further comprising:

at least one substantially flat third display panel removably insertable in said third channel, said third display panel having a thickness that is less than a width of said third channel; said third display panel comprising indicia on at least one surface that is viewable through said third wall when said display panel is in said second channel; and a third channel end cap comprising a distal end that is slidably insertable in said third channel creating a friction fit and sealing access to said second channel.

6. A media display system as recited in claim 3, further comprising:

at least one substantially flat second display panel removably insertable in said second channel, said second display panel having a thickness that is less than a width of said second channel; said second display panel comprising indicia on at least one surface that is viewable through said second wall when said display panel is in said second channel; and a second channel end cap comprising a distal end that is slidably insertable in said second channel creating a friction fit and sealing access to said second channel.

7. A media display system as recited in claim 1, further comprising:

at least one substantially flat display panel removably insertable in said channel, said display panel having a width that is less than a width of said channel; said display panel including indicia on at least one surface that is viewable through said frame mount when said display panel is in said channel.

8. A media display system as recited in claim 1, wherein said lower flange projects from said lower wall toward said upper flange and behind said upper flange.

9. A media display system as recited in claim 1, wherein said upper flange and said lower flange merge to provide a unitary wall opposite said first wall.

10. A vehicle parking space media display system for displaying interchangeable signs on a parking bumper, curb or wall in a parking space, said media display system comprising:

a frame mount comprising:

a first wall having a front surface, a rear surface, an upper end and a lower end and a first side end and a second side end;

an upper flange projecting outward and depending downward from said upper wall behind said rear surface and having an elongated free end; and a lower flange projecting outward and upward from said lower wall toward said upper flange behind said rear surface and having an elongated free end;

an upper channel defined by said upper flange and said rear surface and a lower channel defined by said lower flange and said rear surface; and an unobstructed opening defined by a space between said free end of said upper flange and said free end of said lower flange; and first end cap comprising a first distal end that is slidably insertable in said upper channel and said lower channel creating a friction fit and sealing access to said upper channel and said lower channel on a first end of said frame mount, said first end cap including an elongated aperture for use in securing said frame mount to a surface in said parking space, a first proximal end opposite said first distal end, a first flat surface extending between said first distal end and said first proximal end and a first lip projecting from said first flat surface proximal said first proximal end for engaging said first end of said frame mount, said first lip and said flat surface defining a first recessed groove for engaging said first end of said frame mount and a second end cap comprising a second distal end that is slidably insertable in said upper channel and said lower channel creating a friction fit and sealing access to said upper channel and said lower channel on a second end of said frame mount, said second end cap including an elongated aperture for use in securing said frame mount to a surface in said parking space, a second proximal end opposite said second distal end, a second flat surface extending between said second distal end and said second proximal end and a second lip projecting from said second flat surface proximal said second proximal end for engaging said second end of said frame mount, said second lip and said flat surface defining a second recessed groove for engaging said second end of said frame mount.

11. A media display system as recited in claim 10, further comprising:

at least one substantially flat display panel removably insertable in said channel, said display panel having a width that is less than a width of said channel; said display panel including indicia on at least one surface that is viewable through said frame mount when said display panel is in said channel.

12. A vehicle parking space media display system for displaying interchangeable signs on a parking bumper, said media display system comprising:

a frame mount comprising:

a first wall having a front transparent surface, a rear surface, an upper end and a lower end; an upper wall projecting from said upper end and a lower wall projecting from said lower end and opposing said upper wall;

an upper flange depending from said upper wall behind said rear surface and having a free end; and a lower flange projecting upward from said lower wall toward said upper flange behind said rear surface and having a free end;

an upper channel defined by said upper flange, said first wall and said rear surface, a lower channel defined by said lower flange, said first was and said rear surface;

at least one substantially flat display panel removably insertable in said upper channel and said lower channel, said display panel having a width that is less than a width of said upper channel and said lower channel; said display panel comprising indicia on at least one surface that is viewable through said frame mount when said display panel is in said upper channel and said lower channel;

a first end cap comprising a first distal end that is slidably insertable in said upper channel and said lower creating a friction fit and sealing access to said upper channel and said lower channel on a first end of said frame mount, said first end cap having an elongated aperture, a first proximal end, a flat surface extending between said first distal end and said first proximal end and a lip projecting from said flat surface over said flat surface, said lip and said flat surface defining a recessed groove for engaging said first end of said frame mount; and a second end cap comprising a second distal end that is slidably insertable in said upper channel and said lower creating a friction fit and sealing access to said upper channel and said lower channel on a second end of said frame mount, said second end cap having an elongated aperture, a first proximal end, a flat surface extending between said second distal end and said second proximal end and a lip projecting from said flat surface over said flat surface, said lip and said flat surface defining a recessed groove for engaging said second end of said frame mount.

* * * * *